US008672315B2

(12) United States Patent
Goto

(10) Patent No.: US 8,672,315 B2
(45) Date of Patent: Mar. 18, 2014

(54) SHEET FEEDER AND IMAGE FORMING APPARATUS

(71) Applicant: Takeshi Goto, Miyagi (JP)

(72) Inventor: Takeshi Goto, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/666,088

(22) Filed: Nov. 1, 2012

(65) Prior Publication Data

US 2013/0127107 A1 May 23, 2013

(30) Foreign Application Priority Data

Nov. 22, 2011 (JP) ..... 2011-255013

(51) Int. Cl.
*B65H 3/44* (2006.01)
*B65H 5/26* (2006.01)

(52) U.S. Cl.
USPC ..... 271/9.01; 271/9.02

(58) Field of Classification Search
USPC ..... 271/9.01, 9.02, 9.11, 9.12
See application file for complete search history.

(56) References Cited

U.S. PATENT DOCUMENTS

| | | | | |
|---|---|---|---|---|
| 4,958,822 | A * | 9/1990 | Rutishauser et al. | 271/9.11 |
| 5,485,990 | A * | 1/1996 | Kato | 271/9.08 |
| 6,032,942 | A * | 3/2000 | Cho | 271/9.11 |
| 6,148,172 | A * | 11/2000 | Kanda et al. | 399/391 |
| 6,273,414 | B1 * | 8/2001 | Matsuo | 271/9.11 |
| 6,674,983 | B2 * | 1/2004 | Enomoto et al. | 399/124 |
| 7,192,023 | B2 * | 3/2007 | Amari et al. | 271/9.11 |
| 8,091,883 | B2 * | 1/2012 | Sakamoto | 271/9.13 |
| 2002/0096817 | A1 | 7/2002 | Miki | |
| 2008/0211176 | A1 | 9/2008 | Miura et al. | |
| 2009/0200729 | A1 | 8/2009 | Okamoto | |
| 2013/0001856 | A1 * | 1/2013 | Uchida | 271/9.11 |

FOREIGN PATENT DOCUMENTS

| | | |
|---|---|---|
| JP | 64-038344 | 2/1989 |
| JP | 2002-255377 | 9/2002 |
| JP | 2008-239343 | 10/2008 |
| JP | 2009-190808 | 8/2009 |

* cited by examiner

*Primary Examiner* — Prasad Gokhale
(74) *Attorney, Agent, or Firm* — Harness, Dickey & Pierce

(57) ABSTRACT

In a sheet feeder comprising a pair of sheet feeding units and an image forming apparatus comprising the sheet feeder according to the present invention, a feed roller of a first sheet feeding unit of the pair of sheet feeding units is driven to rotate when a driving source of the first sheet feeding unit rotates in the forward direction, and a conveying roller of a second sheet feeding unit of the pair of sheet feeding units is driven to rotate when the driving source of the first sheet feeding unit rotates in the backward direction.

8 Claims, 7 Drawing Sheets

SHEET FEEDER AND IMAGE FORMING APPARATUS

CROSS-REFERENCE TO RELATED APPLICATIONS

The present application claims priority to and incorporates by reference the entire contents of Japanese Patent Application No. 2011-255013 filed in Japan on Nov. 22, 2011.

BACKGROUND OF THE INVENTION

1. Field of the Invention

The present invention relates to a sheet feeder and an image forming apparatuses including the sheet feeder.

2. Description of the Related Art

A sheet feeder provided in an image forming apparatus to feed paper one sheet by one sheet from a paper tray where a plurality of sheets of the paper for use in image formation is stacked is known. The sheet feeder includes a feed roller that conveys the sheet of paper picked up from the paper tray and a conveying roller (also referred to as a "grip roller") that conveys the paper conveyed by the feed roller downstream in a conveying direction. A two-circuit drive system made up of a drive system for driving the feed roller and a drive system for driving the conveying roller is necessary to drive the sheet feeder.

Such a two-circuit drive system can be constructed using a structure in which the feed roller and the conveying roller are driven by different driving sources. However, this structure requires that a single paper tray should include at least two driving sources. Accordingly, the number of driving sources becomes large in an image forming apparatus that includes a plurality of paper trays, which disadvantageously leads to an increase in cost and an increase in space occupied by the drive system. To that end, there is proposed a technique of providing a single driving source in a single paper tray and driving a feed roller and a conveying roller by switching a rotating direction of the driving source in the middle of paper conveyance.

Known examples of a sheet feeder that employs such a driving motor of which rotating direction can be reversed include that disclosed in Japanese Patent Application Laid-open No. 2008-239343 and that disclosed in Japanese Patent No. 3782721.

According to a technique disclosed in Japanese Patent Application Laid-open No. 2008-239343, rotations of the sheet feed roller and the conveying roller are controlled using a motor of which rotating direction can be reversed. This control is performed such that when the motor rotates forward, the sheet feed roller and the conveying roller are rotated, but when the motor rotates backward, only the conveying roller is rotated. More specifically, the motor is rotated forward when sheet feeding is started, and stopped when a sensor detects that a leading end of the sheet (paper) has reached a nip portion between registration rollers. After a lapse of a predetermined period of time, the motor is rotated backward in synchronization with rotations of the registration rollers to thereby rotate only the conveying roller.

When a sheet is to be fed from a second (lower) paper cassette of vertically-stacked two paper cassettes, a first motor of a first (upper) paper cassette is rotated backward, and a second motor of the second paper cassette is rotated forward until the sheet reaches the nip portion. When the sheet reaches the nip portion, the second motor is rotated backward as in the case described above, causing both the first motor and the second motor to rotate backward. When a sheet of a small size is fed, the second motor is temporarily stopped, and thereafter rotated backward to prevent feeding of multiple sheets (double feed of sheets).

According to a technique described in Japanese Patent No. 3782721, a sheet feeder rotates a feed roller, a separation roller, and a conveying roller using a single motor of which rotating direction can be reversed. More specifically, when the motor rotates forward, all of the feed roller, the separation roller, and the conveying roller are rotated, but when the motor rotates backward, only the separation roller and the conveying roller are rotated. Switching between the forward rotation and the backward rotation of the motor takes place when a sensor arranged downstream of the conveying roller detects a leading end of paper.

When a plurality of sheet feeders are provided, switching may be performed as follows, for example. A motor of an upper sheet feeding unit is rotated backward, and when a sheet is to be fed from a lowermost sheet feeding unit, rotation of a motor of the lowermost sheet feeding unit, from which the sheet is to be fed, is switched from forward rotation to backward rotation in the middle of sheet conveyance.

To switch the rotating direction of the driving motor in the middle of sheet feeding as described above, it is necessary to decelerate the driving motor to a halt, reverse the rotating direction, and thereafter accelerate the motor. Time is lost in the process of this series of operations. In addition, backlash of meshed gears further increases the loss of time. These set a limit on further increase in processing speed. Furthermore, abrupt reversing of the rotating direction can disadvantageously increase a load placed on the drive system.

SUMMARY OF THE INVENTION

It is an object of the present invention to at least partially solve the problems in the conventional technology.

A sheet feeder comprising a pair of sheet feeding units.

Each of the sheet feeding units includes: a paper tray for holding paper therein; a pickup roller configured to pick up the paper from the paper tray; a feed roller configured to convey the picked up paper out from the paper tray; a separation roller configured to be in press contact with the feed roller to be rotated via a torque limiter in a direction in which the separation roller returns the paper back to the paper tray; a conveying roller a conveying roller configured to convey the paper conveyed out from the paper tray by the feed roller; and a driving source configured to rotate selectively in a forward direction and a backward direction.

The feed roller of a first sheet feeding unit of the pair of sheet feeding units is driven to rotate when the driving source of the first sheet feeding unit rotates in the forward direction, and the conveying roller of a second sheet feeding unit of the pair of sheet feeding units is driven to rotate when the driving source of the first sheet feeding unit rotates in the backward direction.

An image forming apparatus comprising a sheet feeder including a pair of sheet feeding units; and an image forming device that forms an image on the paper fed from the sheet feeder.

Each of the sheet feeding units includes: a paper tray for holding paper therein; a pickup roller configured to pick up the paper from the paper tray; a feed roller configured to convey the picked up paper out from the paper tray; a separation roller configured to be in press contact with the feed roller to be rotated via a torque limiter in a direction in which the separation roller returns the paper back to the paper tray; a conveying roller configured to convey the paper conveyed out from the paper tray by the feed roller; and a driving source configured to rotate selectively in a forward direction and a backward direction.

The feed roller of a first sheet feeding unit of the pair of sheet feeding units is driven to rotate when the driving source of the first sheet feeding unit rotates in the forward direction, and the conveying roller of a second sheet feeding unit of the pair of sheet feeding units is driven to rotate when the driving source of the first sheet feeding unit rotates in the backward direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
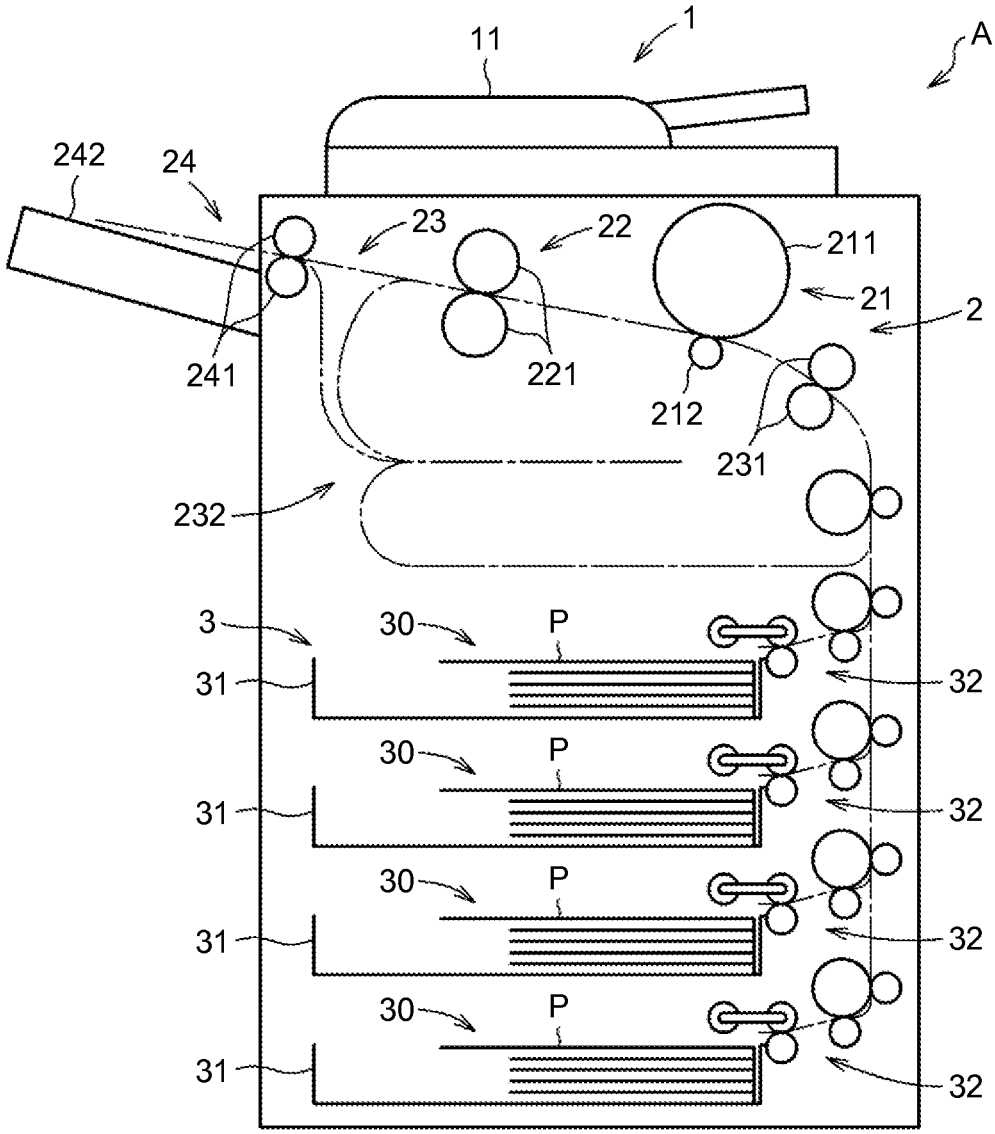
FIG. 1 is a cross-sectional view illustrating an image forming apparatus according to an embodiment of the present invention.

Exemplary embodiments of the present invention are described below with reference to the accompanying drawings. FIG. 1 illustrates an image forming apparatus according to an embodiment of the present invention.

In the description below, a "first sheet feeding unit" denotes a sheet feeding unit equipped with a driving source. A "second driving sheet feeding unit" denotes a sheet feeding unit that is not equipped with a driving source.

As illustrated in FIG. 1, an image forming apparatus A which can be, for example, a monochrome electrophotographic printer includes a document scanning section 1, an image forming device 2, and a sheet feeding section 3.

The document scanning section 1 is positioned atop the image forming apparatus A and includes a document supplying section 11 that supplies a plurality of document sheets one sheet by one sheet and a document scanner (not shown) that scans the supplied document to obtain an image of the document.

The document supplying section 11 includes a document tray on which a plurality of document sheets are to be placed, a plurality of conveying rollers that picks up and feeds the placed document one sheet by one sheet, and, when document scanning is completed, carries the document to a document exit section, and a guide member that guides the document during carriage. The document scanner includes an exposure glass on which the carried document is stopped with a to-be-scanned side facing down and a scanning unit that reciprocates in a prescribed direction at a position where the scanning unit faces the exposure glass to obtain an image of the document by scanning.

The image forming device 2 includes a writing section (not shown), an image forming section 21, a fixing section 22, a conveying path 23, and an exit section 24.

The writing section is positioned in an upper portion of the image forming device 2 and includes a light source that emits light such as laser light and various optical systems. More specifically, the writing section emits light according to image data generated based on the scanned image obtained by the document scanning section 1 onto a photosensitive element 211 of the image forming section 21, which will be described later, thereby performing exposure of a surface of the photosensitive element 211.

The image forming section 21 is positioned below the writing section and includes an image forming unit that is detachably attachable to the image forming apparatus A. The image forming unit includes the photosensitive element 211 capable of carrying black toner which is a developer on a surface of the photosensitive element 211, a roller charging device that uniformly electrostatically charges the surface of the photosensitive element 211, a developing device that supplies toner onto the surface of the photosensitive element 211, and a photosensitive-element cleaning blade for cleaning the surface of the photosensitive element 211. A transfer roller 212 corresponding to a transfer section is arranged at a position where the transfer roller 212 faces the photosensitive element 211 with the conveying path 23 where paper P is to be conveyed therebetween. The transfer roller 212 presses the photosensitive element 211. Accordingly, a transfer nip portion is formed between the photosensitive element 211 and the transfer roller 212.

The fixing section 22 is positioned downstream of the transfer nip portion in a direction in which the paper P is conveyed (hereinafter, "paper conveying direction") and includes a pair of fixing rollers 221 made up of a fixing roller to be heated by a heating source (not shown) and a pressing roller that can press the fixing roller.

The conveying path 23 is a conveying passage on which the paper P conveyed out from the sheet feeding section 3 is to be carried and extends to the exit section 24 which will be described later. Arranged at appropriate positions along the conveying path 23 are a pair of registration rollers 231 and pairs of conveying rollers (not shown). A reversing mechanism 232 is arranged downstream of the fixing section 22 in the conveying direction. The reversing mechanism 232 includes a turning section that turns the paper P output from the exit section 24 upside down using a plurality of conveying rollers (not shown) and a conveying section that conveys the turned-upside-down paper P back to the image forming device 2 so that images are formed on both sides of the paper P.

The exit section 24 is arranged most downstream of the conveying path 23 and includes a pair of sheet discharging rollers 241 that discharges the paper P out of the image forming apparatus A and a sheet output tray 242 where the discharged paper P is to be stacked.

The sheet feeding section 3 is positioned in a lower portion of the image forming apparatus A and includes a plurality of (in the example illustrated in FIG. 1, four) sheet feeding units 30 that are vertically stacked. Each of the sheet feeding units 30 includes a paper tray 31 for holding a plurality of sheets of the paper P stacked on the paper tray 31 and a sheet feeding mechanism 32 that picks up the paper P from the paper tray 31 and conveys the paper P to the conveying path 23.

Basic operations of the image forming apparatus A are described below with reference to FIG. 1.

The image forming apparatus A scans a document as a first step of image formation. When a plurality of document sheets are placed on the document tray of the document supplying section 11 and then a start button (not shown) is pressed, document scanning and image formation are started. The first sheet of the document to be scanned is conveyed by a document conveying section onto the exposure glass, scanned by the document scanner, and thereafter discharged to the document exit section. In a case where the document is a book or the like, the document may be manually placed on the exposure glass and scanned one page one page.

Subsequently, the image forming device 2 starts image formation. The photosensitive element 211 of the image forming unit is rotated counterclockwise in FIG. 1 by a driving device (not shown), and the surface of the photosensitive element 211 is uniformly electrostatically charged by the roller charging device in predetermined polarity. The electrostatically-charged surface of the photosensitive element 211 is illuminated with laser light according to information about an image to be formed. As a result, an electrostatic latent image is formed on the surface of the photosensitive element 211. The image information according to which the photosensitive element 211 is exposed is image information obtained by scanning by a document scanning unit. Black toner is supplied from the developing device to the electrostatic latent image formed on the photosensitive element 211 in this way, thereby developing the electrostatic latent image into a toner image (developer image) which is a visible image.

Meanwhile, when image formation is started, the paper P is sent to the conveying path 23 out from the paper tray 31 of any one of the sheet feeding units 30 of the sheet feeding section 3 in the lower portion of the image forming apparatus A. The paper P sent to the conveying path 23 is conveyed by the pair of registration rollers 231 at predetermined timing to the transfer nip portion where the toner image is transferred onto the paper P. More specifically, a transfer bias that is opposite in polarity to the polarity of the charged toner image on the photosensitive element 211 is applied to the transfer roller 212 in this state. Therefore, a transfer electric field is applied to the transfer nip portion. This transfer electric field causes the toner image on the photosensitive element 211 to be transferred onto the paper P.

Thereafter, residual toner sticking to the surface of the photosensitive element 211 is removed by the photosensitive-element cleaning blade. Subsequently, a neutralizing device neutralizes the surface to return the surface potential to its original potential to prepare for next image formation. The removed residual toner is conveyed and collected by a screw, a waste-toner transferring hose, or the like (not shown) into a waste toner container.

The paper P onto which the toner image is transferred is conveyed to the fixing section 22 where the paper P is heated and pressed by the pair of fixing rollers 221 made up of the heated fixing roller and the pressing roller. As a result, the toner image is fixed onto the paper P. The paper P onto which the toner image is fixed is separated from the pair of fixing rollers 221. The paper P is further conveyed by the pairs of conveying rollers (not shown) and discharged by the pair of sheet discharging rollers 241 in the exit section 24 out of the image forming apparatus A to be loaded on the sheet output tray 242.

Figure 2:
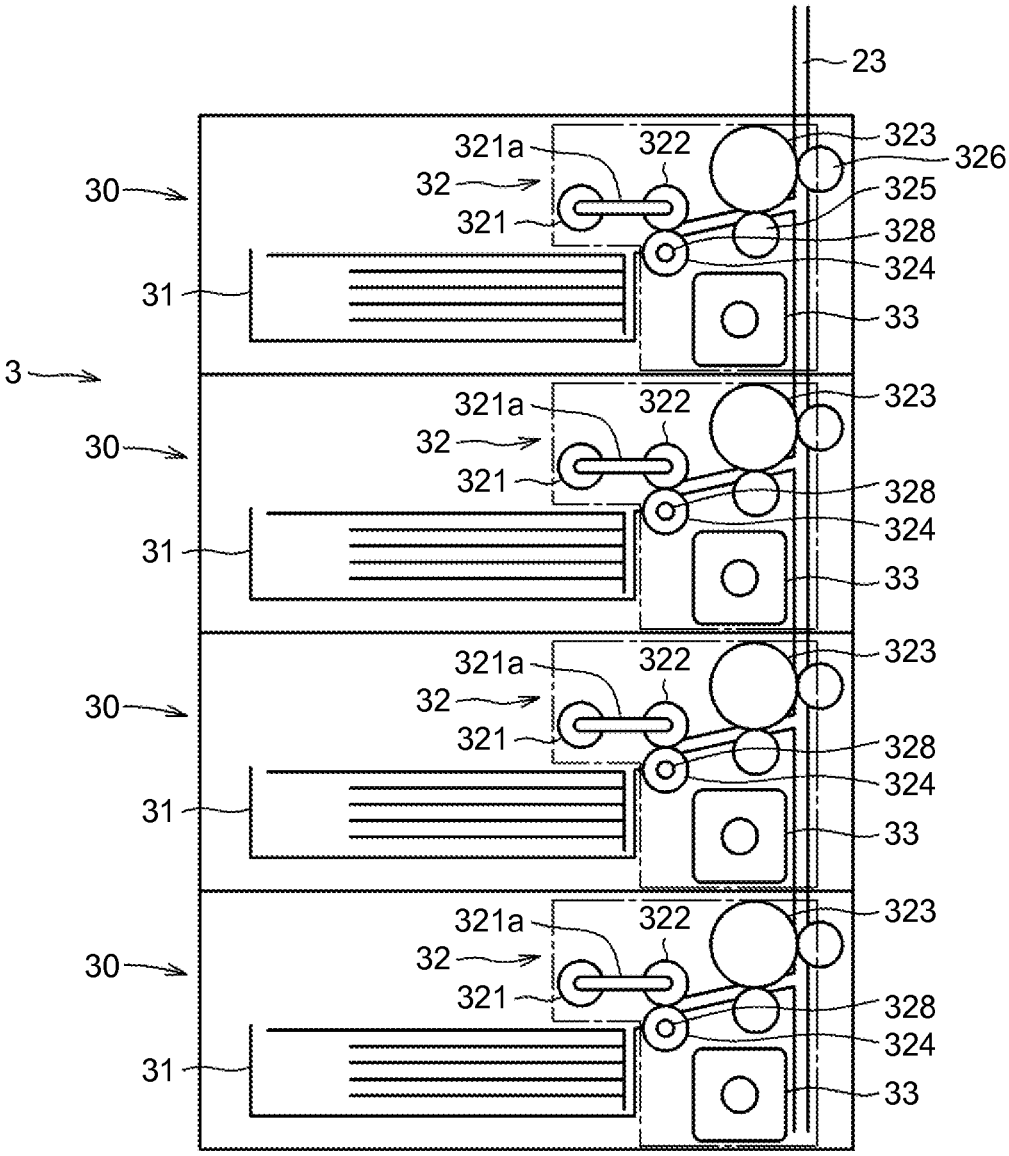
FIG. 2 is a side view schematically illustrating a sheet feeding section of the image forming apparatus illustrated in FIG. 1.

The configuration of the sheet feeding section 3 is described in detail below with reference to FIG. 2. FIG. 2 is a side view schematically illustrating the configuration of the sheet feeding section 3. As illustrated in FIG. 2, the sheet feeding section 3 according to the present embodiment includes the four vertically-stacked sheet feeding units 30. Because the sheet feeding units 30 are identical in configuration, only the configuration of an uppermost one of the sheet feeding units 30 is described below, and description about the other sheet feeding units 30 is omitted.

The sheet feeding unit 30 includes the paper tray 31 for holding a plurality of sheets of the paper P stacked thereon and the sheet feeding mechanism 32 that picks up the paper P from the paper tray 31 one sheet by one sheet and conveys the paper P out from the paper tray 31 to the conveying path 23.

The paper tray 31 is detachably attached to a body of the image forming apparatus A and holds a plurality of sheets of the paper P on which images are to be formed. Sheets of the paper P of a same size are loaded in each of the paper trays 31 in a stacked manner. Sheets of the paper P loaded in the paper trays 31 differ in size or, even when the sheets are of a same size, differ in orientation among the plurality of sheet feeding units 30. There can be a case where sheets of the paper P of a same size are loaded into different two or more of the paper trays 31 for large-volume printing or the like.

The sheet feeding mechanism 32 includes a pickup roller 321 that picks up the paper P, a feed roller 322 that conveys the picked-up paper P out from the paper tray 31, a conveying roller 323 that carries the paper P to the conveying path 23, a separation roller 324 that prevents double feed of sheets of the paper P, a driving source 33, a torque transmission mechanism 34 (see FIGS. 3A and 3B) that transmits an output of the driving source 33 to the rollers 321 to 324, and driven rollers 325 and 326 that are arranged at two positions on the perimeter of the conveying roller 323. A nip portion is formed between each of the driven rollers 325 and 326 and the conveying roller 323.

The pickup roller 321 is arranged right above the paper tray 31. The feed roller 322 is arranged adjacent to the paper tray 31 to receive the paper P picked up by the pickup roller 321 and convey the paper P out from the paper tray 31. The pickup roller 321 and the feed roller 322 are rotatably supported by a connecting arm 321*a*. The connecting arm 321*a* is rotatable about a rotating shaft of the feed roller 322. Rotating the connecting arm 321*a* brings the pickup roller 321 into contact with or away from an uppermost sheet of the paper P in the paper tray 31.

The conveying roller 323 is larger in diameter than the pickup roller 321 and the feed roller 322. The conveying roller 323 changes the paper conveying direction of the paper P that is conveyed to the conveying roller 323 by the feed roller 322 upward, thereby carrying the paper P to the conveying path 23 that extends through the sheet feeding units 30.

The separation roller 324 is arranged to be in press contact with the feed roller 322. Accordingly, a nip portion is formed between the separation roller 324 and the feed roller 322. A torque limiter 328 is interposed between the separation roller 324 and a driving shaft that drives the separation roller 324. An input torque is applied to the driving shaft of the separation roller 324 in a counter-rotating direction relative to the rotating direction of the feed roller 322. With the configuration described above, the torque limiter 328 cuts off transmission of an input torque to the separation roller 324 when only a single sheet of the paper P is fed to the nip portion. Accordingly, the separation roller 324 is rotated by rotation of the feed roller 322, causing the paper P to be kept to be conveyed to the conveying roller 323 by a conveyance force applied by the feed roller 322. However, when two or more sheets of the paper P laid on one another are fed to the nip portion, the separation roller 324 is counter-rotated by the input torque. As a result, sheets of the paper P other than a sheet of the paper P that is in contact with the feed roller 322 are returned to the paper tray 31, while the sheet of the paper P that is in contact with the feed roller 322 is kept to be conveyed by the feed roller 322. Thus, conveyance of multiple sheets (double feed of sheets) of the paper P is prevented. The separation roller 324 may be configured to be operable to come contact with and away from the feed roller 322.

A motor of which rotating direction can be reversed between a forward direction and a backward direction, e.g., a stepping motor, is used as the driving source 33.

The configuration of the torque transmission mechanism 34 of the sheet feeding mechanism 32 is described below with reference to FIGS. 3A and 3B. Note that the feed roller 322 is omitted from FIGS. 3A and 3B to simplify the illustration and facilitate understanding (the same applies to FIGS. 4A and 4B, and FIGS. 5A and 5B).

Figure 3A:
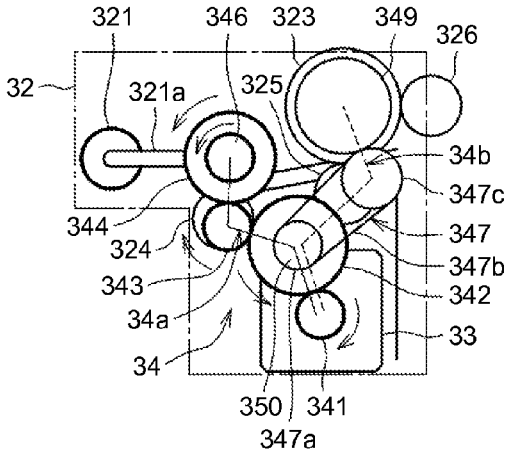
FIGS. 3A and 3B are a side view schematically illustrating how a sheet feeding mechanism operates when a driving source rotates forward and a side view schematically illustrating how the sheet feeding mechanism operates when the driving source rotates backward, respectively.

As illustrated in FIG. 3A, the torque transmission mechanism 34 of the sheet feeding mechanism 32 is broadly divided into a first torque transmission mechanism 34*a* and a second torque transmission mechanism 34*b*. The first torque transmission mechanism 34*a* transmits the torque generated by the driving source 33 to the feed roller 322 via a first torque transmission path indicated by solid lines. The second torque transmission mechanism 34*b* transmits the torque generated by the driving source 33 to the conveying roller 323 via a second torque transmission path indicated by broken lines.

The first torque transmission mechanism 34*a* includes a driver gear 341 attached to an output shaft of the driving source 33, two intermediate gears (a first intermediate gear 342 and a second intermediate gear 343), a first output gear 344 attached to a driving shaft of the feed roller 322, and a first one-way clutch 346 interposed between the first output gear 344 and the feed roller 322. An input side of the first one-way clutch 346 is connected to the first output gear 344; an output side of the same is connected to the driving shaft of the feed roller 322. When an input torque is applied to the first one-way clutch 346 in a direction that rotates the feed roller 322 in the paper conveying direction, the first one-way clutch 346 is put in a locked state where the first one-way clutch 346 transmits the input torque to the feed roller 322 on the output side. However, when an input torque in the direction opposite thereto is applied to the first one-way clutch 346, the first one-way clutch 346 is put in a free-wheeling state. As a result, torque transmission to the feed roller 322 is cut off.

The second torque transmission mechanism 34*b* includes the driver gear 341, the first intermediate gear 342, a second one-way clutch 350, a first belt transmission device 347, and a second output gear 349. The driver gear 341 and the first intermediate gear 342 are shared between the second torque transmission mechanism 34*b* and the first torque transmission mechanism 34*a*. A driving shaft of the conveying roller 323 is attached to the second output gear 349.

Figure 3B:
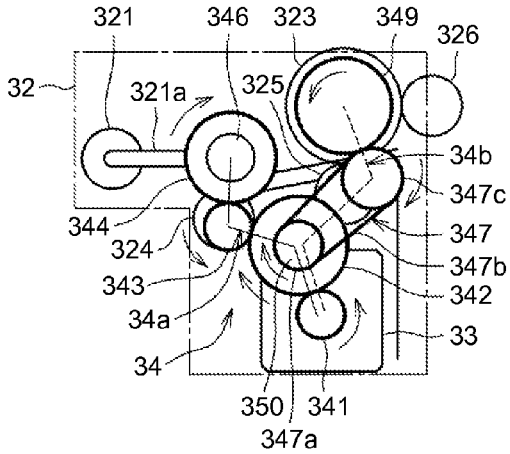
Figure 6:
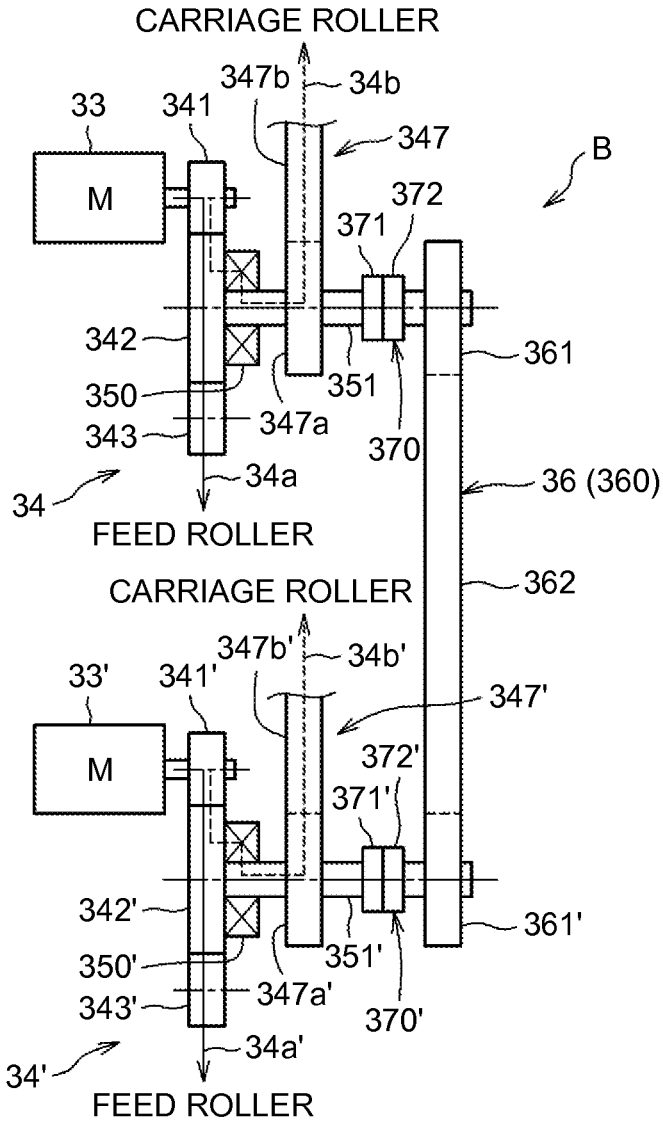
FIG. 6 is a front view schematically illustrating the sheet feeder according to the embodiment.

FIG. 6 is a front view of the torque transmission mechanism 34 (note that this diagram schematically illustrates the configuration of the torque transmission mechanism 34; arrangement of elements does not conform to that of FIGS. 3A and 3B). As illustrated in FIG. 6, the second one-way clutch 350 is fixed at its input side to the first intermediate gear 342. A torque transmission shaft 351 that is not coupled to the first intermediate gear 342 is fixed to an output side of the second one-way clutch 350. A driving pulley 347*a* of the first belt transmission device 347 is mounted on the torque transmission shaft 351. An input torque applied to the torque transmission shaft 351 is transmitted via the driving pulley 347*a* and a belt 347*b* to a driven pulley 347*c* (see FIG. 3A) and then transmitted to the second output gear 349 via a gear (not shown) connected to the driven pulley 347*c*. When an input torque in a direction that rotates the conveying roller 323 in the paper conveying direction is applied to the second one-way clutch 350, the second one-way clutch 350 is put in a locked state where the second one-way clutch 350 transmits the input torque to the torque transmission shaft 351 on the output side. However, when an input torque in the direction opposite thereto is applied to the second one-way clutch 350, the second one-way clutch 350 is put in a free-wheeling state. As a result, torque transmission to the conveying roller 323 is cut off.

The torque input to the feed roller 322 is transmitted to the pickup roller 321 via a torque transmission mechanism (not shown) (e.g., a belt transmission device). With the configuration described above, when the feed roller 322 is rotated, the pickup roller 321 is rotated in the same direction in synchronization with the feed roller 322.

The torque input to the conveying roller 323 is transmitted to the separation roller 324 via a torque transmission mechanism (not shown) (e.g., a belt transmission device). With the configuration described above, when the conveying roller 323 is rotated, the separation roller 324 is rotated in the same direction in synchronization with the conveying roller 323.

Operations of the sheet feeding mechanism 32 described above are described with reference to FIGS. 3A and 3B. Note that each of mechanical elements to which a torque is to be input is illustrated in solid lines in FIGS. 3A and 3B (the same applies to FIGS. 4A and 4B and FIGS. 5A and 5B).

As illustrated in FIG. 3A, when the driving source 33 is rotated in the forward direction (clockwise in FIG. 3A), a torque generated by the driving source 33 is transmitted to the first output gear 344 via the driver gear 341, the first intermediate gear 342, and the second intermediate gear 343 that make up the first torque transmission mechanism 34*a*. Thus, the first output gear 344 is rotated forward (counterclockwise in FIG. 3A). In this state where the first output gear 344 is rotated forward, the first one-way clutch 346 is put in the locked state. Accordingly, the feed roller 322 and also the pickup roller 321 are rotated in the same direction in synchronization with the first output gear 344. On the other hand, the second one-way clutch 350 is put in the free-wheeling state. Accordingly, the torque is not transmitted to the first belt transmission device 347 and therefore not transmitted to the second output gear 349. Therefore, the conveying roller 323 and the separation roller 324 are put in a stopped state.

As illustrated in FIG. 3B, when the driving source 33 is rotated backward, each of the first output gear 344, the first intermediate gear 342, the second intermediate gear 343, and the driver gear 341 that make up the first torque transmission mechanism 34*a* is rotated backward. However, a torque input to the first one-way clutch 346 in this state puts the first one-way clutch 346 in the free-wheeling state. Accordingly, the torque is not transmitted to the feed roller 322, causing the feed roller 322 (and also the pickup roller 321) to stop. On the other hand, in this state where the first intermediate gear 342 is rotated backward, the second one-way clutch 350 is put in the locked state. Accordingly, the output torque of the driving source 33 is transmitted to the second output gear 349 via the first intermediate gear 342, the second one-way clutch 350, the torque transmission shaft 351 (see FIG. 6), and the first belt transmission device 347. As a result, the conveying roller 323 is rotated.

Figure 4A:
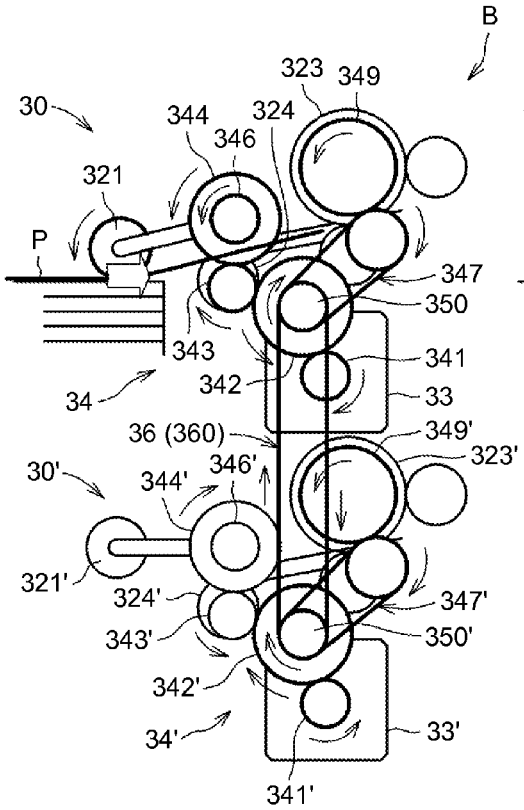
FIGS. 4A and 4B are a side view schematically illustrating a first half of a sheet feeding step performed by a sheet feeder according to an embodiment of the present invention when an upper sheet feeding unit performs sheet feeding and a side view schematically illustrating a second half of the sheet feeding step, respectively.

The sheet feeding mechanism 32 described above is contained in every one of the sheet feeding units 30, 30'. The image forming apparatus A according an embodiment of the present embodiment includes, in addition to the configuration described above, a third torque transmission mechanism 36 that transmits a torque between a pair of the sheet feeding units 30 as illustrated in FIG. 4A. More specifically, as illustrated in FIG. 6, the third torque transmission mechanism 36 couples output sides of the second one-way clutches 350, 350' of the pair of sheet feeding units 30, 30' in a manner such that torque transmission therebetween is possible. Illustrated in FIG. 6 is an example where a second belt transmission device 360 is used as the third torque transmission mechanism 36. The second belt transmission device 360 includes pulleys 361, 361' mounted on the torque transmission shafts 351 of the sheet feeding units 30 and a belt 362 laid around the pulleys 361. A sheet feeder B according to the embodiment includes the two sheet feeding mechanisms 32, 32' each of which belongs to one of the pair of sheet feeding units 30, 30' and the third torque transmission mechanism 36. Another sheet feeder B may be made up of the sheet feeding mechanisms 32, 32'(see FIG. 7) of the remaining two sheet feeding units 30, 30' and another third torque transmission mechanism.

Figure 7:
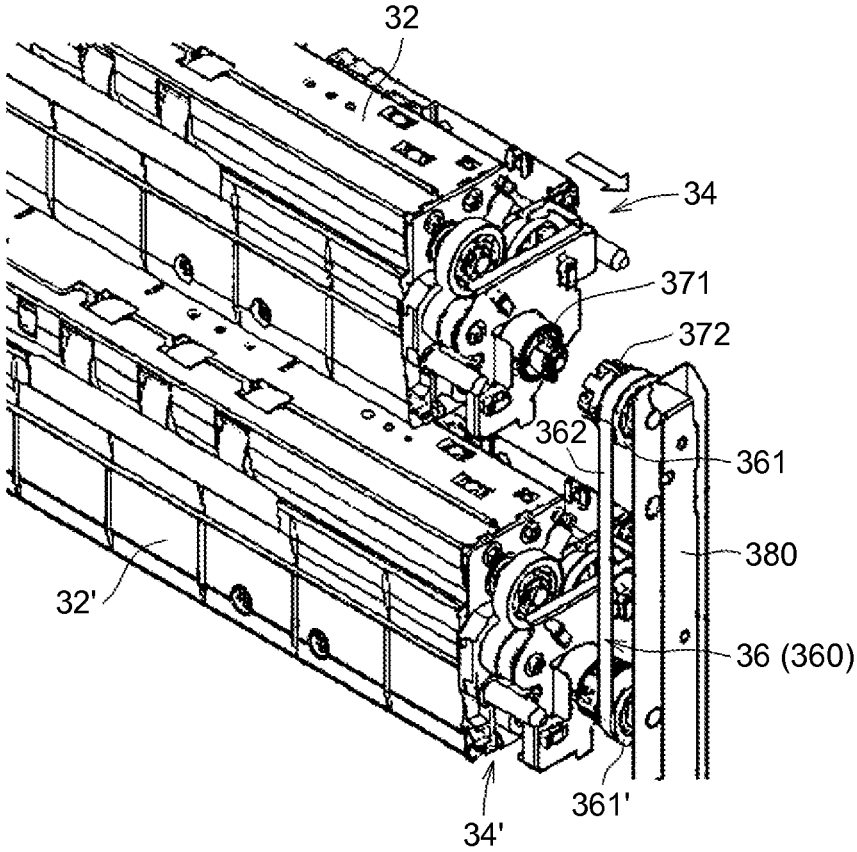
FIG. 7 is a perspective view illustrating operations of mounting/dismounting a sheet feeding unit on/from the sheet feeder.

As illustrated in FIG. 6, the sheet feeder B preferably includes a joint 370(370') interposed between the third torque transmission mechanism 36 and an end of the torque transmission shaft 351(351') on the side of the second torque transmission mechanism 34*b*(34*b*') so that the torque transmission shaft 351(351') can be divided into a part on the side of the second torque transmission mechanism 34*b*(34*b*') and a part on the side of the third torque transmission mechanism 36. The joint 370(370') can be made up of, for example, a male piece 371(371') arranged on the portion of the torque transmission shaft 351(351') on the side of the second torque transmission mechanism 34*b*(34*b*') and a female piece 372 (372') arranged on the portion of the torque transmission shaft 351(351') on the side of the third torque transmission mechanism 36. The female piece 372(372') is axially detachably insertable onto the male piece 371(371') and allows torque transmission to and from the male piece 371(371') in an inserted state. When this configuration is employed, a mechanical element (which includes the pulleys 361, 361' in the present embodiment) that belongs to the third torque transmission mechanism 36 is supported by a frame 380 of the image forming apparatus A as illustrated in FIG. 7.

The configuration described above allows unitizing the sheet feeding mechanism 32 that includes the rollers 321 to 326(321' to 326'), the driving source 33(33'), and the torque transmission mechanism 34(34') for each of the sheet feeding units 30, 30' and detachably mounting the unitized sheet feeding mechanism 32(32') on the body of the image forming apparatus A. This leads to enhancement of maintainability of the sheet feeding mechanism 32(32') and also maintainability of the third torque transmission mechanism 36.

Sheet feeding operations to be performed by the sheet feeder B described above are described below with reference to FIGS. 4A and 4B and FIGS. 5A and 5B. In the description below, corresponding mechanical elements of the pair of sheet feeding units 30, 30' are denoted by a same reference numeral. However, reference numerals of mechanical elements of the sheet feeding unit 30' that does not perform sheet feeding are each marked with an apostrophe to distinguish them from the mechanical elements of the sheet feeding unit 30 that performs sheet feeding.

Figure 4B:
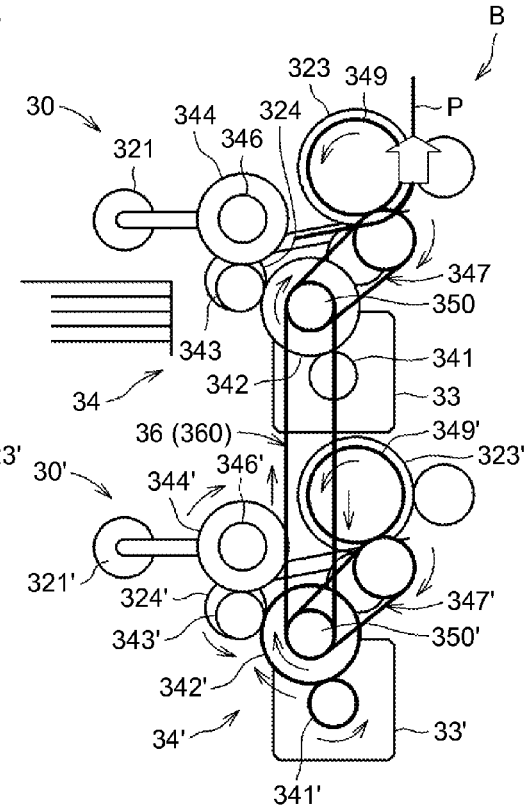

FIGS. 4A and 4B are schematic diagrams illustrating how the sheet feeder B operates when an upper one (hereinafter, the "upper sheet feeding unit") of the pair of sheet feeding units 30 performs sheet feeding. FIG. 4A illustrates a first half of a sheet feeding step. FIG. 4B illustrates a second half of the sheet feeding step.

When an instruction to perform sheet feeding is transmitted to the upper sheet feeding unit 30, the driving source 33 of the upper sheet feeding unit 30 is rotated forward, while the driving source 33' of a lower one (hereinafter, the "lower sheet feeding unit") of the pair of sheet feeding units 30' that does not perform sheet feeding is rotated backward as illustrated in FIG. 4A. A forward torque generated by the driving source 33 of the upper sheet feeding unit 30 is transmitted to the first output gear 344 via the driver gear 341, the first intermediate gear 342, and the second intermediate gear 343. This torque puts the first one-way clutch 346 in the locked state where the feed roller 322 and also the pickup roller 321 are rotated. Accordingly, the pickup roller 321 and the feed roller 322 perform picking up of the paper P and conveyance of the paper P, respectively.

In the lower sheet feeding unit 30', a backward torque generated by the driving source 33' puts the second one-way clutch 350' in the locked state. Therefore, this torque is transmitted to the torque transmission shaft 351 of the upper sheet feeding unit 30 via the driver gear 341', the first intermediate gear 342', the second one-way clutch 350', the torque transmission shaft 351' (see FIG. 6), and the third torque transmission mechanism 36 (the second belt transmission device 360). This torque is then transmitted to the second output gear 349 via the first belt transmission device 347 of the upper sheet feeding unit 30. As a result, the conveying roller 323 of the upper sheet feeding unit 30 is rotated, and, furthermore, an input torque for preventing double feed of sheets is applied to the separation roller 324.

At this time, the driving source 33 of the upper sheet feeding unit 30 is rotating in the direction that puts the second one-way clutch 350 in the free-wheeling state. Accordingly, the torque generated by the driving source 33 is cut off by the second one-way clutch 350 and not transmitted to the torque transmission shaft 351. Accordingly, the conveying roller 323 is rotated only by the backward torque input from the driving source 33' of the lower sheet feeding unit 30'.

The paper P conveyed out from the paper tray 31 by the feed roller 322 reaches the conveying roller 323. A sensor that detects a leading end of paper to determine whether the paper P has reached the conveying roller 323 is arranged downstream of a downstream one of the two nip portions (the nip portion between the conveying roller 323 and the upstream driven roller 325 and the nip portion between the conveying roller 323 and the downstream driven roller 326) formed on the periphery of the conveying roller 323. The detection sensor is an optical sensor of either a transmission type or a reflection type that includes a light emitter and a light receiver. The detection sensor detects when light received by the light receiver is blocked by the paper P, thereby detecting conveyance of the leading end of the paper P.

When the sensor detects passage of the leading end of the paper P through the downstream nip portion on the conveying roller 323, the driving source 33 of the upper sheet feeding unit 30 is stopped as illustrated in FIG. 4B. Contrasted therewith, the driving source 33' of the lower sheet feeding unit 30' continues rotating backward. Accordingly, the feed roller 322 and the pickup roller 321 to which a rotation torque is not applied are stopped, whereas the conveying roller 323 and the separation roller 324 to which the input torque is applied from the driving source 33' of the lower sheet feeding unit 30' continue rotating. As a result, the paper P is conveyed to the conveying path 23 (see FIG. 2) by the conveying 323.

As illustrated in FIGS. 4A and 4B, the backward torque, although this torque has no direct relation with the sheet feeding operations, generated by the backward rotation of the driving source 33' of the lower sheet feeding unit 30' is transmitted to the second output gear 349' via the second one-way clutch 350' and the first belt transmission device 347' while the driving source 33' is rotating backward. Accordingly, the conveying roller 323' and also the separation roller 324' of the lower sheet feeding unit 30' are kept being rotated.

How the sheet feeder B operates when the lower sheet feeding unit 30 performs sheet feeding is described below with reference to FIGS. 5A and 5B. Sheet feeding operations in this situation are basically same as those described above with reference to FIGS. 4A and 4B except that the sheet feeding unit that performs sheet feeding and the sheet feeding unit that does not perform sheet feeding are interchanged.

Figure 5A:
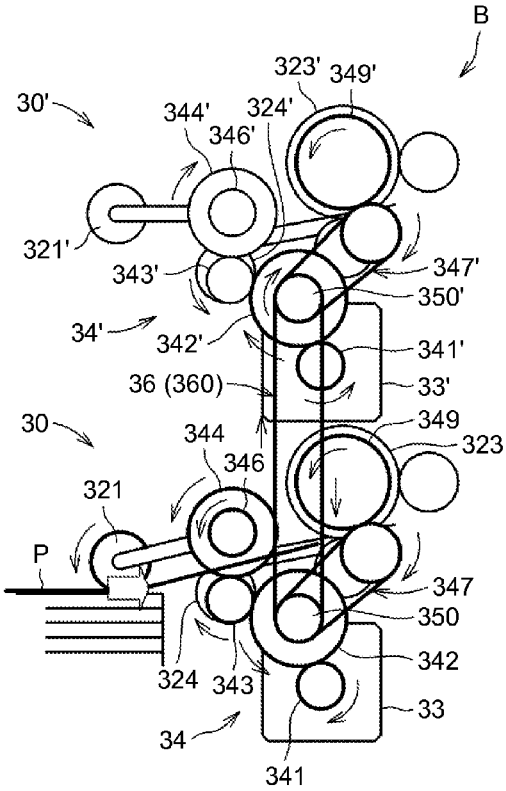
FIGS. 5A and 5B are a side view schematically illustrating a first half of a sheet feeding step performed by the sheet feeder according to the embodiment when a lower sheet feeding unit performs sheet feeding and a side view schematically illustrating a second half of the sheet feeding step, respectively.

More specifically, in a first half of this sheet feeding step, the driving source 33 of the lower sheet feeding unit 30 that performs sheet feeding is rotated forward, while the driving source 33' of the upper sheet feeding unit 30' that does not perform sheet feeding is rotated backward as illustrated in FIG. 5A. A forward torque generated by the driving source 33 of the lower sheet feeding unit 30 is transmitted to the feed roller 322 via the driver gear 341, the first intermediate gear 342, the second intermediate gear 343, the first output gear 344, and the first one-way clutch 346. As a result, the feed roller 322 and the pickup roller 321 are rotated. This forward torque puts the second one-way clutch 350 in the free-wheeling state. Accordingly, this torque is not transmitted to the conveying roller 323 via the first belt transmission device 347 and the second output gear 349.

In the upper sheet feeding unit 30', the backward torque generated by the driving source 33' is transmitted to the third torque transmission mechanism 36 (the second belt transmission device 360) via the driver gear 341', the first intermediate gear 342', the second one-way clutch 350', and the torque transmission shaft 351' (see FIG. 6) of the upper sheet feeding unit 30'. This torque is then transmitted to the torque transmission shaft 351 (see FIG. 6) of the lower sheet feeding unit 30 and further transmitted to the second output gear 349 via the first belt transmission device 347. As a result, the conveying roller 323 and also the separation roller 324 are rotated.

Figure 5B:
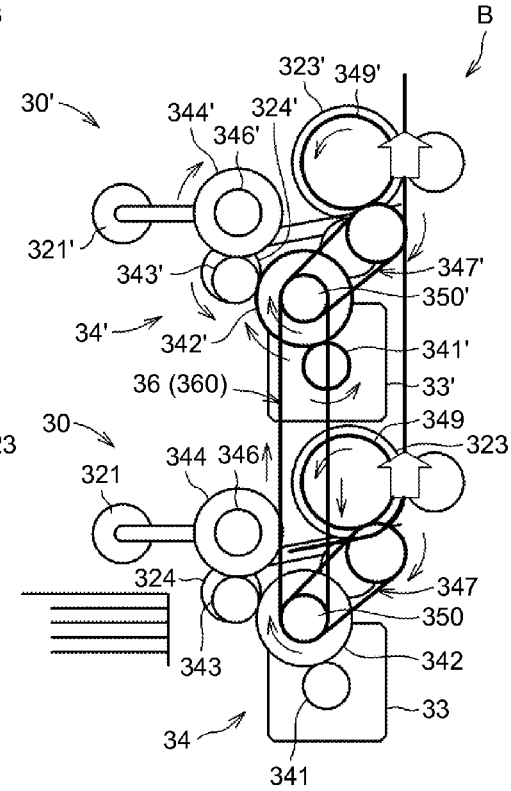

When the paper P reaches the conveying roller 323 and the sensor detects that the leading end of the paper P has passed through the downstream nip portion on the conveying roller 323, the driving source 33 of the lower sheet feeding unit 30 is stopped as illustrated in FIG. 5B. Contrasted therewith, the driving source 33' of the upper sheet feeding unit 30' continues rotating backward. Accordingly, although the feed roller 322 and the pickup roller 321 of the lower sheet feeding unit 30 are stopped, the conveying roller 323 and the separation roller 324 to which the backward torque is input from the driving source 33' of the lower sheet feeding unit 30' continue rotating. As a result, the paper P is conveyed to the conveying path 23 by the conveying roller 323.

At this time, the conveying roller 323' of the upper sheet feeding unit 30' is kept being rotated by the backward rotation of the driving source 33' of the upper sheet feeding unit 30'. Therefore, the paper P conveyed to the conveying path 23 is carried by the conveying roller 323 of the lower sheet feeding unit 30, and thereafter further carried along the conveying path 23 by the conveying roller 323' of the upper sheet feeding unit 30'. Thus, the paper P is reliably conveyed to the registration rollers 231.

The sheet feeder B according to the embodiment described above yields the following effects.

Each of the driving sources 33, 33' of the pair of sheet feeding units 30, 30' operates as follows. When the driving source 33 of a first sheet feeding unit 30 of the sheet feeding units 30, 30' is rotated in the forward direction, the driving source 33 rotates the feed roller 322 of the first sheet feeding unit 30, but when the driving source 33 is rotated in the backward direction, the driving source 33 rotates the conveying roller 323 of a second sheet feeding unit 30' of the sheet feeding units 30. Accordingly, when sheet feeding is performed by the first sheet feeding unit 30, it is possible to cause the feed roller 322 of the first sheet feeding unit 30 to be rotated by the driving source 33 of the first sheet feeding unit 30 and the conveying roller 323 of the first sheet feeding unit to be rotated by the driving source 33' of the second sheet feeding unit 30'. Accordingly, it is possible to control rotations of the feed roller 322 and the conveying roller 323 independently by individually controlling the driving sources 33 of the pair of sheet feeding units 30 even when the configuration in which each of the sheet feeding units 30 includes the single driving source 33 is employed. As a result, it becomes possible to rotate the conveying roller 323 without a break over a period during which the paper P is transferred from the feed roller 322 to the conveying roller 323, thereby eliminating the need of reversing rotation (rotate forward→stop→rotate backward) of the driving source 33 that rotates the conveying roller 323. Furthermore, it is not necessary to rotate backward the driving source 33 that rotates the feed roller 322; what is required is only to stop the driving source 33 at predetermined timing. Accordingly, loss of time due to stopping and reversing rotation of the driving source 33 can be reduced to achieve high-speed processing. Furthermore, because the need of reversing rotation of the driving source is eliminated, backlash of meshed gears is eliminated, and hence sudden driving connection does not occur. Therefore, a load placed on the drive system is reduced, and durability of the mechanical elements of the torque transmission mechanism 34 is increased.

When a conventional configuration in which rotation of the driving sources 33 of the sheet feeding units 30 are individually reversed during sheet feeding is employed, it is necessary to continuously drive the driving sources 33 of all the sheet feeding units 30 to carry the paper P conveyed out from the paper tray 31 upward along the conveying path 23 in the sheet feeding section 3. In contrast, the sheet feeder B according to the present embodiment can convey the paper P along the conveying path 23 in the sheet feeding section 3 only by driving the driving source 33 of one of the pair of sheet feeding units 30, 30'. Accordingly, reduction in electric power consumption can be achieved.

Figure 8:
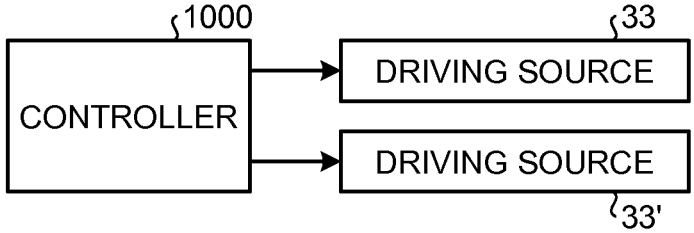
FIG. 8 is a block diagram illustrating a controller that controls driving sources, the controller being included in a body of the image forming apparatus according to the embodiment of the present invention.

In addition, though a controller that controls both of the driving sources 33 and 33' is omitted from FIG. 1, the body of the image forming apparatus includes the controller 1000 that controls both of the driving sources 33 and 33' as shown in FIG. 8.

Figure 9:
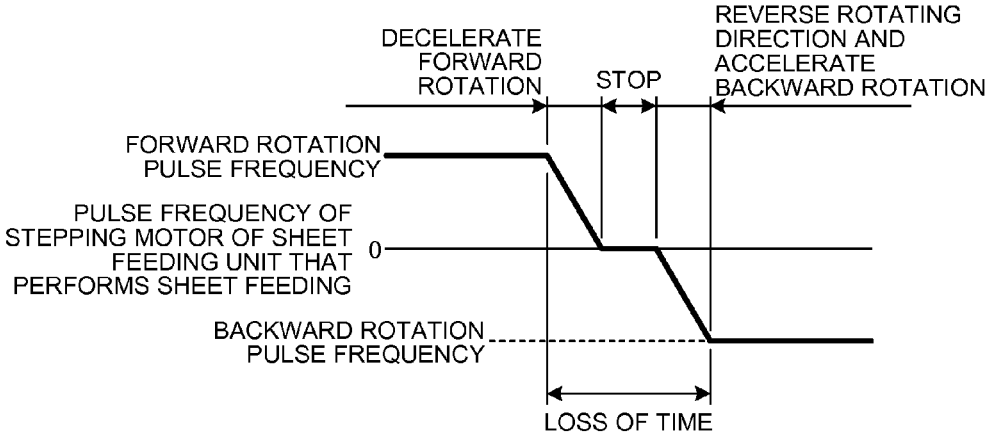
FIG. 9 is a diagram illustrating pulse frequency (pulses per second (PPS)) of a driving source of a conventional mechanism.

FIG. 9 is a diagram illustrating pulse frequency (pulses per second (PPS)) of pulse signals of the stepping motor for rotating the conveying roller 323 as with a conventional technique by switching rotation of the driving source 33 (the stepping motor) provided in each of the sheet feeding units from forward to backward.

FIG. 9 shows that reversing rotation of the stepping motor involves decelerating (forward rotation), stopping, reversing the rotating direction, and thereafter accelerating (backward rotation). Therefore, each of time necessary to decelerate, time necessary to stop, and time necessary to accelerate becomes loss of time.

Figure 10:
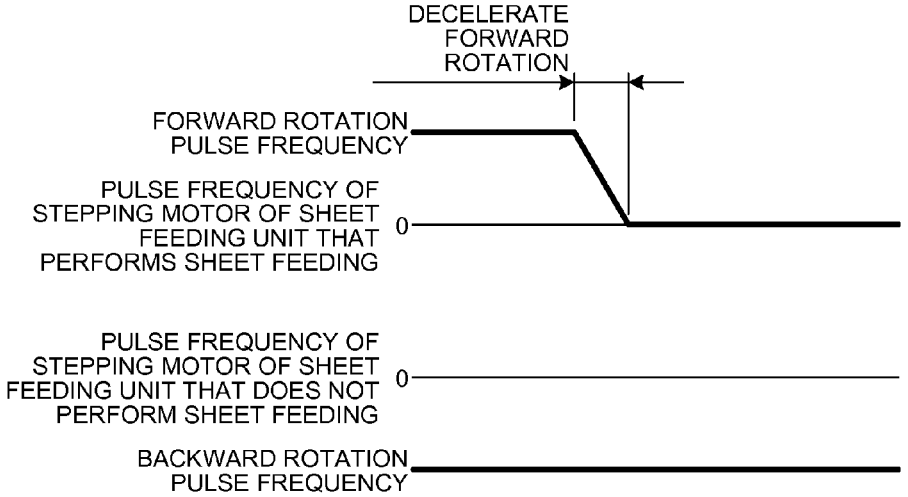
FIG. 10 is a diagram illustrating pulse frequency (PPS) of driving sources according to the embodiment.

FIG. 10 is a diagram illustrating pulse frequency of the driving sources 33 (the stepping motors) of the sheet feeder B according to the present embodiment. As illustrated in FIG. 10, even in the sheet feeder B according to the present embodiment, the stepping motor 33 of the sheet feeding unit 30 that performs sheet feeding has a period during which forward rotation of the stepping motor 33 is decelerated. However, none of the stepping motors of the upper and lower sheet feeding units 30 has a period during which the rotating direction is reversed and then backward rotation is accelerated. Thus, because time spent to accelerate rotation of the stepping motor does not affect paper productivity, enough time can be taken to accelerate the rotation. Accordingly, a load placed on the stepping motor 33 can be reduced. It becomes possible to achieve high-speed conveyance or to bear a high conveyance load that can be placed during feed of thick paper.

Configuration features of the sheet feeder B according to aspects of the present invention that yields the above effects are enumerated below.

(1) The sheet feeder B includes the pair of sheet feeding units 30. Each of the sheet feeding units 30 includes the paper tray 31 for holding paper therein, the pickup roller 321 that picks up the paper from the paper tray 31, the feed roller 322 that conveys the picked up paper out from the paper tray 31, the separation roller 324 that is in press contact with the feed roller 322 to be rotated via the torque limiter in the direction in which the separation roller 324 returns the paper back to the paper tray 31, the conveying roller 323 that carries the paper conveyed out from the paper tray 31 by the feed roller 322, and the single driving source 33 of which rotating direction is switchable between the forward direction and the backward direction. When the driving source 33 of the first sheet feeding unit 30 of the pair of sheet feeding units 30, 30' is rotated forward, the driving source 33 rotates the feed roller 322 of the first sheet feeding unit 30, but when the driving source 33 of the first sheet feeding unit is rotated in the backward direction, the driving source 33 rotates the conveying roller 323' of the second sheet feeding unit 30' of the pair of sheet feeding units 30, 30'.

(2) Each of the sheet feeding units 30 further includes the first torque transmission mechanism 34*a* that transmits a torque generated by the driving source 33 of the sheet feeding unit 30 to the feed roller 322 of the sheet feeding unit 30 via the first torque transmission path, the second torque transmission mechanism 34*b* that transmits the torque generated by the driving source 33 of the sheet feeding unit 30 to the conveying roller 323 of the sheet feeding unit 30 via the second torque transmission path, the first one-way clutch 346 arranged on the first torque transmission path, and the second one-way clutch 350 arranged on the second torque transmission path. The first one-way clutch 346 is put in the locked state under application of the torque generated by forward rotation of the driving source 33, but put in the free-wheeling state under application of the torque generated by backward rotation of the driving source 33. The second one-way clutch 350 is put in the free-wheeling state under application of the torque generated by forward rotation of the driving source 33, but put in the locked state under application of the torque generated by backward rotation of the driving source 33.

(3) Each of the sheet feeding units 30, 30' further includes the third torque transmission mechanism 36 arranged on the output side of the second one-way clutch 350(350'). The third torque transmission mechanism 36 transmits a torque between the pair of sheet feeding units 30, 30'.

(4) In the middle of sheet feeding performed by one sheet feeding unit 30 of the pair of sheet feeding units 30, the driving source 33 of the one sheet feeding unit 30 is switched from a forward-rotating state to a backward-rotating state, but the driving source 33' of the other sheet feeding unit 30' of the pair of sheet feeding units 30 is maintained in a backward-rotating state during the sheet feeding.

(5) Each of the sheet feeding units 30, 30' further includes the torque transmission shaft 351(351') that transmits a torque between the second torque transmission mechanism 34*b* (34*b*') and the third torque transmission mechanism 36. The torque transmission shaft 351(351') is dividable into the part on the side of the second torque transmission mechanism 34*b*(34*b*') and the part on the side of the third torque transmission mechanism 36.

(6) The third torque transmission mechanism 36 is supported by the frame 380.

(7) In each of the sheet feeding units 30, the conveying roller 323 and the separation roller 324 are coupled in such a manner that torque transmission therebetween is possible.

(8) In each of the sheet feeding units 30, the feed roller 322 and the pickup roller 321 are coupled in such a manner that torque transmission therebetween is possible.

Preferred embodiments of the present invention have been described above. It should be understood that the present invention is not limited to the embodiments, and various modifications can be made within the scope of the present invention. For instance, any configuration with which a torque can be transmitted can be used as the configuration of each of the first torque transmission mechanism 34*a*, the second torque transmission mechanism 34*b*, and the third torque transmission mechanism 36. A selected one of a gear train, a belt transmission device, and a combination thereof can be employed as appropriate.

The image forming apparatus A according to the present invention is described by way of an example of the monochrome image forming apparatus A; however, the image forming apparatus A may alternatively be a color image forming apparatus including four image forming units. The image forming apparatus A may alternatively be configured to form a toner image by temporarily transferring an image formed on the photosensitive element 211 onto an intermediate transfer belt and transfers the toner image onto conveyed paper. The image forming apparatus can form a monochrome image by using any one of the four image four units. The image forming apparatus can also form a two-color a three-color image by using two or three image forming units. The image forming apparatus A according to the present invention may be a copier, a printer, a facsimile, or a multifunction peripheral that includes two or more functions of these.

According to an aspect of the present invention, each of driving sources of a pair of sheet feeding units operates as follows. When the driving source of a first feeding unit of the sheet feeding units is rotated forward, the driving source rotates a feed roller of the first sheet feeding unit, but when the driving source is rotated backward, the driving source rotates a conveying roller of a second sheet feeding unit of the sheet feeding units. Accordingly, when sheet feeding is performed by the first sheet feeding unit of the sheet feeding units, it is possible to cause the feed roller of the first sheet feeding unit to be rotated by the driving source of the first sheet feeding unit, while causing the conveying roller of the first sheet feeding unit to be rotated by the driving source of the second sheet feeding unit. Accordingly, it is possible to control rotations of the feed roller and the conveying roller independently by individually controlling the driving sources of the pair of sheet feeding units even when the configuration in which each of the sheet feeding units includes the single driving source is employed. This allows rotating the conveying roller without a break over a period during which the paper is transferred from the feed roller to the conveying roller, thereby eliminating the need of reversing rotation (forward→stop→backward) of the driving source that rotates the conveying roller. Furthermore, it is not necessary to rotate backward the driving source that rotates the feed roller; what is required is only to stop the driving source at predetermined timing. Accordingly, loss of time due to stopping and reversing rotation of the driving source can be reduced to achieve high-speed processing. Furthermore, a load placed on the drive system can be reduced.

It is an object of the present invention to provide a sheet feeder that is compact but enables high-speed processing by reducing loss of time produced during sheet feeding and simultaneously reducing a load placed on a drive system.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeder comprising a pair of sheet feeding units, each of the sheet feeding units including a paper tray for holding paper therein, a pickup roller configured to pick up the paper from the paper tray, a feed roller configured to convey the picked up paper out from the paper tray, a separation roller configured to be in press contact with the feed roller to be rotated via a torque limiter in a direction in which the separation roller returns the paper back to the paper tray, a conveying roller configured to convey the paper conveyed out from the paper tray by the feed roller, a driving source configured to rotate selectively in a forward direction and a backward direction, wherein the feed roller of a first sheet feeding unit of the pair of sheet feeding units is driven to rotate when the driving source of the first sheet feeding unit rotates in the forward direction, and the conveying roller of a second sheet feeding unit of the pair of sheet feeding units is driven to rotate when the driving source of the first sheet feeding unit rotates in the backward direction, a first torque transmission mechanism configured to transmit a torque generated by the driving source of the first sheet feeding unit to the feed roller of the first sheet feeding unit via a first torque transmission path, a second torque transmission mechanism configured to transmit the torque generated by the driving source of the first sheet feeding unit to the conveying roller of the second sheet feeding unit via a second torque transmission path, a first one-way clutch arranged on the first torque transmission path, the first one-way clutch being put in a locked state when a torque generated by forward rotation of the driving source is applied to the first one-way clutch, the first one-way clutch being put in a free-wheeling state when a torque generated by backward rotation of the driving source is applied to the first one-way clutch, and a second one-way clutch arranged on the second torque transmission path, the second one-way clutch being put in a free-wheeling state when the torque generated by forward rotation of the driving source is applied to the second one-way clutch, the second one-way clutch being put in a locked state when the torque generated by backward rotation of the driving source is applied to the second one-way clutch.

2. The sheet feeder according to claim 1, wherein each of the sheet feeding units further includes a third torque transmission mechanism arranged on an output side of the second one-way clutch, the third torque transmission mechanism transmitting a torque between the pair of sheet feeding units.

3. The sheet feeder according to claim 2, wherein in middle of sheet feeding performed by one sheet feeding unit of the pair of sheet feeding units, the driving source of the one sheet feeding unit is switched from a forward-rotating state to a stop state, and the driving source of other one of the pair of sheet feeding units is maintained in a backward-rotating state during the sheet feeding.

4. The sheet feeder according to claim 2, wherein each of the sheet feeding units further includes a torque transmission shaft that transmits a torque between the second torque transmission mechanism and the third torque transmission mechanism, and the torque transmission shaft is dividable into a part on the side of the second torque transmission mechanism and a part on the side of the third torque transmission mechanism.

5. The sheet feeder according to claim 4, wherein the third torque transmission mechanism is supported by a frame.

6. The sheet feeder according to claim 1, wherein in each of the sheet feeding units, the conveying roller and the separation roller are coupled in such a manner that torque transmission therebetween is possible.

7. The sheet feeder according to claim 1, wherein in each of the sheet feeding units, the feed roller and the pickup roller are coupled in such a manner that torque transmission therebetween is possible.

8. An image forming apparatus comprising:

a sheet feeder including a pair of sheet feeding units; and an image forming device that forms an image on a paper fed from the sheet feeder, each of the sheet feeding units including a paper tray for holding paper therein, a pickup roller configured to pick up the paper from the paper tray, a feed roller configured to convey the picked up paper out from the paper tray, a separation roller configured to be in press contact with the feed roller to be rotated via a torque limiter in a direction in which the separation roller returns the paper back to the paper tray, a conveying roller configured to convey the paper conveyed out from the paper tray by the feed roller, a driving source configured to rotate selectively in a forward direction and a backward direction, wherein the feed roller of a first sheet feeding unit of the pair of sheet feeding units is driven to rotate when the driving source of the first sheet feeding unit rotates in the forward direction, and the conveying roller of a second sheet feeding unit of the pair of sheet feeding units is driven to rotate when the driving source of the first sheet feeding unit rotates in the backward direction, a first torque transmission mechanism configured to transmit a torque generated by the driving source of the first sheet feeding unit to the feed roller of the first sheet feeding unit via a first torque transmission path, a second torque transmission mechanism configured to transmit the torque generated by the driving source of the first sheet feeding unit to the conveying roller of the second sheet feeding unit via a second torque transmission path, a first one-way clutch arranged on the first torque transmission path, the first one-way clutch being put in a locked state when a torque generated by forward rotation of the driving source is applied to the first one-way clutch, the first one-way clutch being put in a free-wheeling state when a torque generated by backward rotation of the driving source is applied to the first one-way clutch, and a second one-way clutch arranged on the second torque transmission path, the second one-way clutch being put in a free-wheeling state when the torque generated by forward rotation of the driving source is applied to the second one-way clutch, the second one-way clutch being put in a locked state when the torque generated by backward rotation of the driving source is applied to the second one-way clutch.

* * * * *